United States Patent [19]

Roulier

[11] 3,999,798

[45] Dec. 28, 1976

[54] COMBINED WHEELCHAIR AND TRAY

[76] Inventor: Thomas M. Roulier, 131 Masten Ave., Cohoes, N.Y. 12047

[22] Filed: May 29, 1975

[21] Appl. No.: 581,793

[52] U.S. Cl. ..... 297/150; 297/DIG. 4

[51] Int. Cl.[2] ..... A47B 39/00

[58] Field of Search ..... 297/155, 154, DIG. 4, 297/148, 150, 162, 194, 153; 108/63; 16/129

[56] References Cited

UNITED STATES PATENTS

| | | | |
|---|---|---|---|
| 189,340 | 4/1877 | Crawford | 108/63 |
| 1,118,170 | 11/1914 | Zaweracz | 108/63 |
| 1,239,018 | 9/1917 | Lilly | 297/148 |
| 1,670,603 | 5/1928 | Weeks | 297/155 X |
| 3,338,627 | 8/1967 | Frank | 297/153 |
| 3,751,789 | 8/1973 | Fink | 297/162 X |
| 3,772,735 | 11/1973 | Lautenschlaeger | 16/129 |

*Primary Examiner*—James T. McCall
*Attorney, Agent, or Firm*—Pierce, Scheffler & Parker

[57] ABSTRACT

A combined wheelchair and tray assembly wherein a foldable tray is hingeably mounted on one arm of the wheelchair in such manner as to permit the tray to be swung away from the occupant of the wheelchair to permit entrance and egress therefrom and wherein the tray may be stored in folded position besides the chair so that the occupant of the wheelchair has convenient access to the drive wheel and brake of said wheelchair.

1 Claim, 4 Drawing Figures

COMBINED WHEELCHAIR AND TRAY

BACKGROUND OF THE INVENTION

Attempts have been made in the prior art to produce a wheelchair for use for invalids or convalescents wherein a tray component was provided which could be moved for horizontal adjustment to accommodate various sized individuals and wherein said tray was hingeably attached to an arm of said wheelchair so that it might be stored in a non-use position at the side of said wheelchair. While such arrangements are an improvement over a wheelchair with a separate tray, they are deficient in that the invalid becomes dependent on an attendant since tray so stored at the side of the wheelchair prevents the operation of either the drive wheels or the brake by the invalid. It is apparent that it is desirable that the invalid be as selfsufficient as possible.

SUMMARY OF THE INVENTION

It is an object of the invention to provide a wheelchair structure having an integral foldable tray coupled to the wheelchair allowing the tray to be moved horizontally relatively to the main body of the wheelchair providing for swinging motion of said tray from an unfolded position of use to a folded position of non-use which does not interfere with the ability of the occupant of said wheelchair to control and propel said wheel chair.

BRIEF DESCRIPTION OF THE DRAWINGS.

Other objects and advantages of the invention will be more fully understood by one skilled in the art by reading the following detailed description of the invention when considered in the light of the accompanying drawings, wherein.

DESCRIPTION OF THE PREFERRED EMBODIMENT

Figure 1:
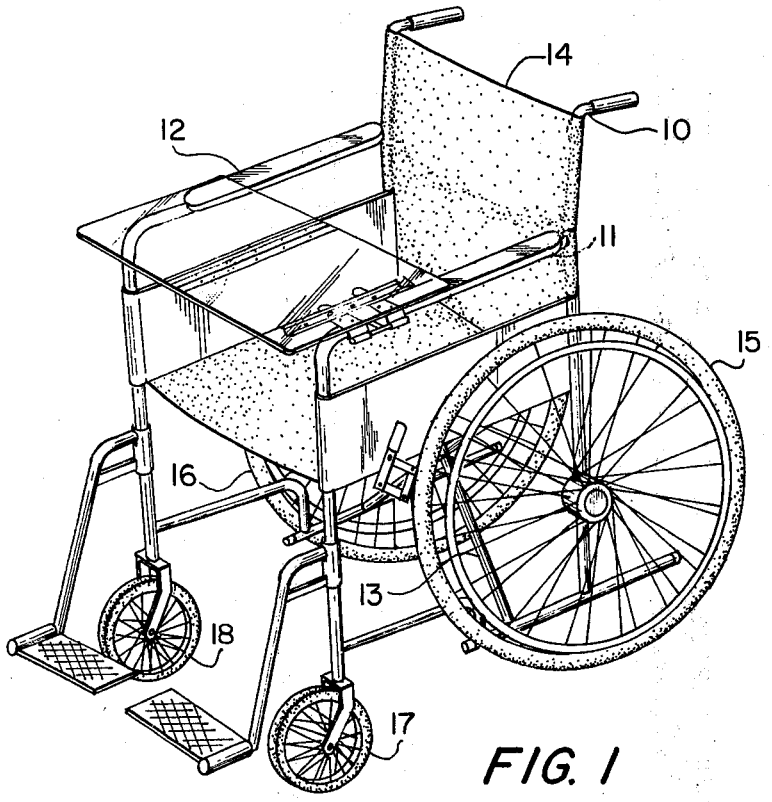
FIG. 1 is a front elevational view of a wheelchair incorporating the features of the invention.

Referring to the drawings, there is illustrated a wheelchair 10 comprising a conventional tubular metallic framework including arms 11 and 12, a seat 13, a back 14, drive wheels 15 and 16, freely swingable wheels 17 and 18 and brakes 19 which are controllably applicable to drive wheels 15 and 16. The tray assembly is mounted on either of arms 11 or 12 depending on the convenience of the wheelchair occupant; whether he is right or left handed, as will be described hereinafter in detail.

Figure 3:
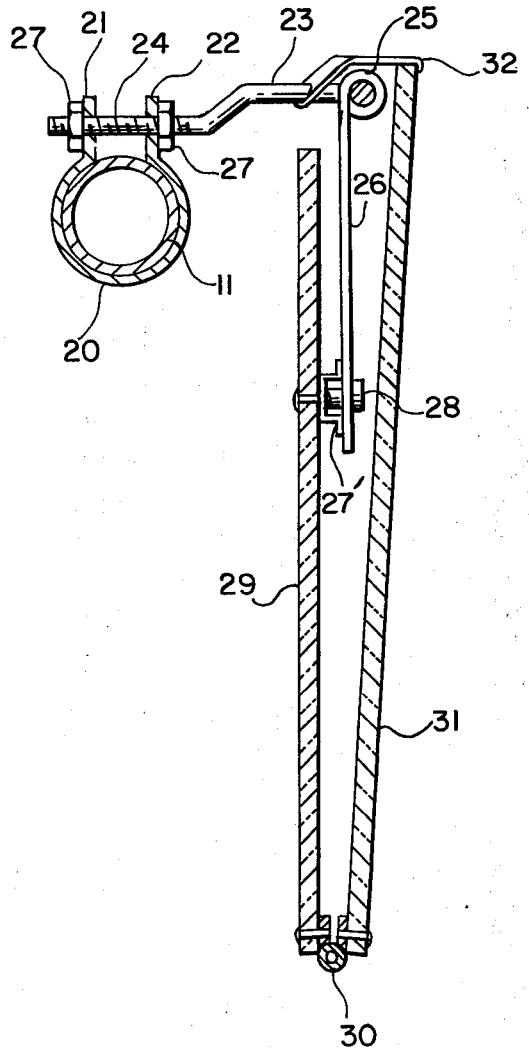
FIG. 3 is a sectional view taken along line 3—3 of FIG. 2.
Figure 4:
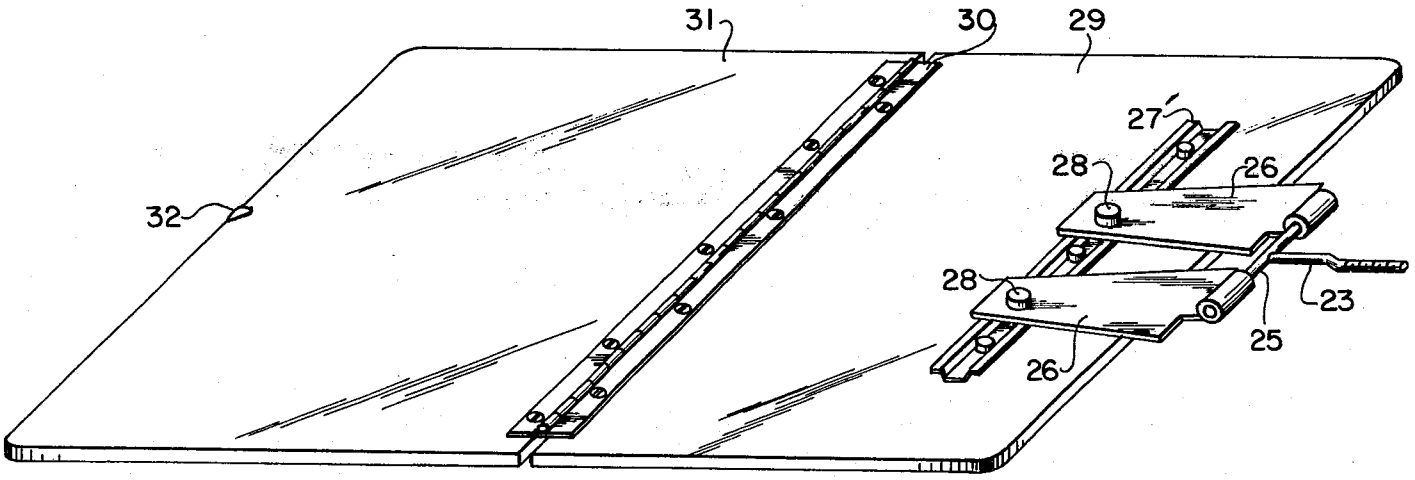
FIG. 4 is a bottom view of the tray showing structural features thereof.

A clamp member 20 as shown in FIG. 3, encircles arm 11. Clamp member 20 is provided with perforate tabs 21, 22. A T shaped bearing member 23 having a threaded shank 24 having nuts 27, 27 threaded thereon engage perforate tabs 21, 22 to securely clamp the clamping member on arm 11 and fix the position of the T shaped bearing member with respect to arm 11. Extending perpendicularly from shank 24 as shown in FIG. 4, are bearing arms 25 which complete the T configuration. Hinge members 26, 26 are pivoted on bearing arms 25, 25. The free ends of hinge members 26 are adjustably attached to channel 27' by clamping means including set screws 28, whereby the position of hinges 26 may be suitably positioned with respect to channel 27'. Channel 27' is suitably fastened to a relatively thin flat plate member 29 which forms part of the tray. One leaf of hinge 30 is suitably fastened to the edge of plate 29 opposite to hinges 26 and the other leaf of hinge 30 is suitably fastened to a second thin flat plate member 31 whose dimensions are such as to overlay plate 29 as best shown in FIG. 3. A spring snap member 32 is fastened to the edge of plate 31 opposite to hinge 30 which cooperates with the shank 24 to hold the assembly closed when it is in stored position as shown in FIG. 3.

Beginning with the tray in stored position as shown in FIG. 3, the occupant of the wheelchair is free to enter or leave the wheelchair. When the wheelchair is occupied, the tray is brought into use by freeing snap member 32 from shank 24, permitting plate 31 to swing on hinge 30, the entire tray assembly swings on bearing arms 25 through an arc of approximately 270° during which time plate 31 continues to swing on hinge 30 so that when plate 29 has substantially swung through an arc of almost 270°, plates 29 and 31 are substantially coplanar and the tray comes to rest on the opposite arm of the wheelchair as shown in FIG. 1. The horizontal position of the tray with respect to the seat of the wheelchair is adjustable for the maximum comfort and convenience of the occupant first by setting the hinge members 26 in channel 27' and setting this position by means of set screws 28 and second by the rotating of hinge members 26 on bearing arms 25. The latter adjustment is most significant since it can be made by the occupant while he is in the wheelchair.

Figure 2:
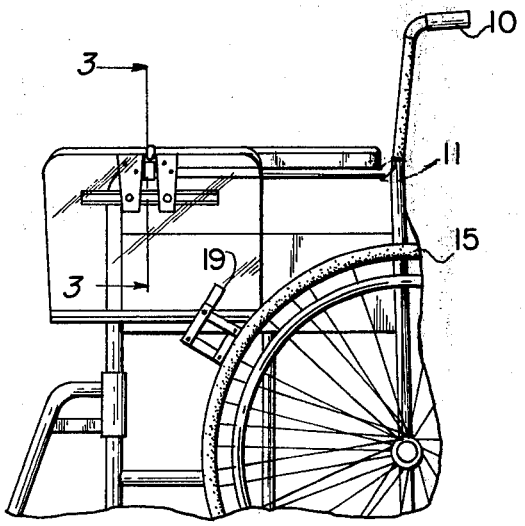
FIG. 2 is an enlarged elevational view of a portion of the wheelchair showing the stored folded tray in relation to the operating parts of the wheel chair.

As shown in FIG. 2, with the tray in stored position besides the wheelchair, the occupant is able to reach and operate both the drive wheels 15, 16 and brake 19 permitting a degree of freedom which is very desirable since it reduces the dependence of the wheelchair occupant on an attendent.

The plate members constituting the tray should be made of a material which is light, strong and attractive. In the preferred embodiment, plexiglass or Lucite is used. However it is apparent that other materials such as aluminum are equally suitable.

In accordance with the provisions of the patent statutes, the principle and mode of operation of the invention have been described, illustrated and explained with respect to a chosen embodiment of the invention. However, it must be understood that within the scope and spirit of the appended claims, the invention may be practiced otherwise than as specifically illustrated and described.

What is claimed is:

1. In combination with a chair structure comprising a seat, back and arms joined by frame members, a tray assembly comprising two substantially flat plate members hingedly joined together at opposed edges by means of a hinge parallel to said edges;

a channel member attached to one of said plate members at an edge opposite to the edge which is hingedly joined to the other of said plate members;

pivot means comprising a T-shaped bearing means and a pair of hinges secured to said bearing means; and horizontally slidably secured to said channel members; and clamping means for securing said bearing means to one of said chair arms, whereby said tray member may be stored in folded condition beside said arm of said chair and may be unfolded and swung about said pivot means and said bearing means through an arc of approximately 270° to rest on both of said arms to provide a tray for the occupant of said chair, and whereby the tray may be horizontally adjusted toward and away from the occupant.

* * * * *